United States Patent [19]

Downing

[11] Patent Number: 4,823,673

[45] Date of Patent: Apr. 25, 1989

[54] SWIVEL ADAPTER FOR A GUN HOLDER

[76] Inventor: William A. Downing, 14001 Hughes Rd. West, Dickinson, Tex. 77539

[21] Appl. No.: 116,897

[22] Filed: Nov. 5, 1987

[51] Int. Cl.[4] ..... F41F 23/14

[52] U.S. Cl. ..... 89/37.04; 224/30 A; 224/36

[58] Field of Search ..... 89/37.04, 37.03, 37.22, 89/40.03; 224/30 A, 35, 36, 39, 41, 913; 280/289 A, 289 H, 769

[56] References Cited

U.S. PATENT DOCUMENTS

| | | | |
|---|---|---|---|
| 573,502 | 12/1896 | Cahill | 224/39 |
| 615,106 | 11/1898 | Satterthwaite | 224/30 A |
| 1,990,865 | 2/1935 | Gonzales . | |
| 2,309,808 | 2/1943 | Trotter . | |
| 2,403,591 | 7/1946 | Ewart . | |
| 2,668,645 | 2/1954 | Pease | 224/913 |
| 2,788,763 | 4/1957 | Ries | 280/289 H |
| 3,559,528 | 2/1971 | Cunningham | 89/40.03 |
| 3,938,719 | 2/1976 | Carlton | 224/36 |
| 4,667,565 | 5/1987 | Anderson | 89/40.03 |

FOREIGN PATENT DOCUMENTS

| | | | |
|---|---|---|---|
| 25815 | of 1901 | United Kingdom | 224/913 |
| 589421 | 11/1933 | Fed. Rep. of Germany | 89/37.03 |
| 957821 | 1/1957 | Fed. Rep. of Germany | 224/36 |

OTHER PUBLICATIONS

Herrman, Coast Artillery Journal, 8/42, pp. 48–49.

*Primary Examiner*—Charles T. Jordan
*Assistant Examiner*—Stephen Johnson
*Attorney, Agent, or Firm*—Robert W. B. Dickerson

[57] ABSTRACT

A device to be positioned intermediate the bar and a mounting bracket of a gun mount, thereby permitting guns mounted thereon to be normally positioned at an angle intermediate the axis of a vehicle and the prependicular thereto.

12 Claims, 2 Drawing Sheets

SWIVEL ADAPTER FOR A GUN HOLDER

BACKGROUND OF THE INVENTION

With the development of off-road machines, including the A.T.V. (All Terrain Vehicle), the number of recreational vehicles has multiplied. Wheeled vehicles have long carried mounting devices for guns. Some typical prior art devices are exemplified by U.S. Pat. Nos. 602,784; 3,473,673; 492,740; 553,614; 3,305,147; 3,142,424; 3,806,010; 4,247,030; and Swiss Patent No. 8,004. Since A.T.V.'s are oftentimes operated in rugged terrain, a gun mount must be sturdy. Further, if the operator's gun is mounted perpendicular to the forward line of travel (the axis of the vehicle), then the ends of the weapon will extend on either side of the vehicle and may be buffeted by trees, bushes or other growth. On occasion, this has caused weapon discharge. If the weapon is so mounted as to point straight ahead, then a forwardly rider would may be in, or at least fear being in, danger. While it is improper to so ride with a loaded gun, on occasion, bullets or shells are inadvertently left in a chamber. This invention attacks all the aforementioned problems.

SUMMARY OF THE INVENTION

Without this invention, the present most widely used A.T.V. gun mount has a mounting bracket secured to a vehicle's struts or handle bars. Said bracket, in turn, is also fastened to a locking bar, which bar carries a pair of removable, flexible, stock-receiving clamps. One or more rifles may be secured by said clamps. The relationship of the bracket to locking bar is such that rifles carried by said locking bar, when the vehicle is moving straight ahead, are either axially aligned with the vehicles, or perpendicular thereto. This invention comprises a rectangular cylinder and a wing-shaped plate. Said wing-shaped plate's wings are secured to the locking bar, and said cylinder to said bracket. Said cylinder and wing-shaped plate are rotatably linked.

DESCRIPTION OF A PREFERRED EMBODIMENT

Figure 1:
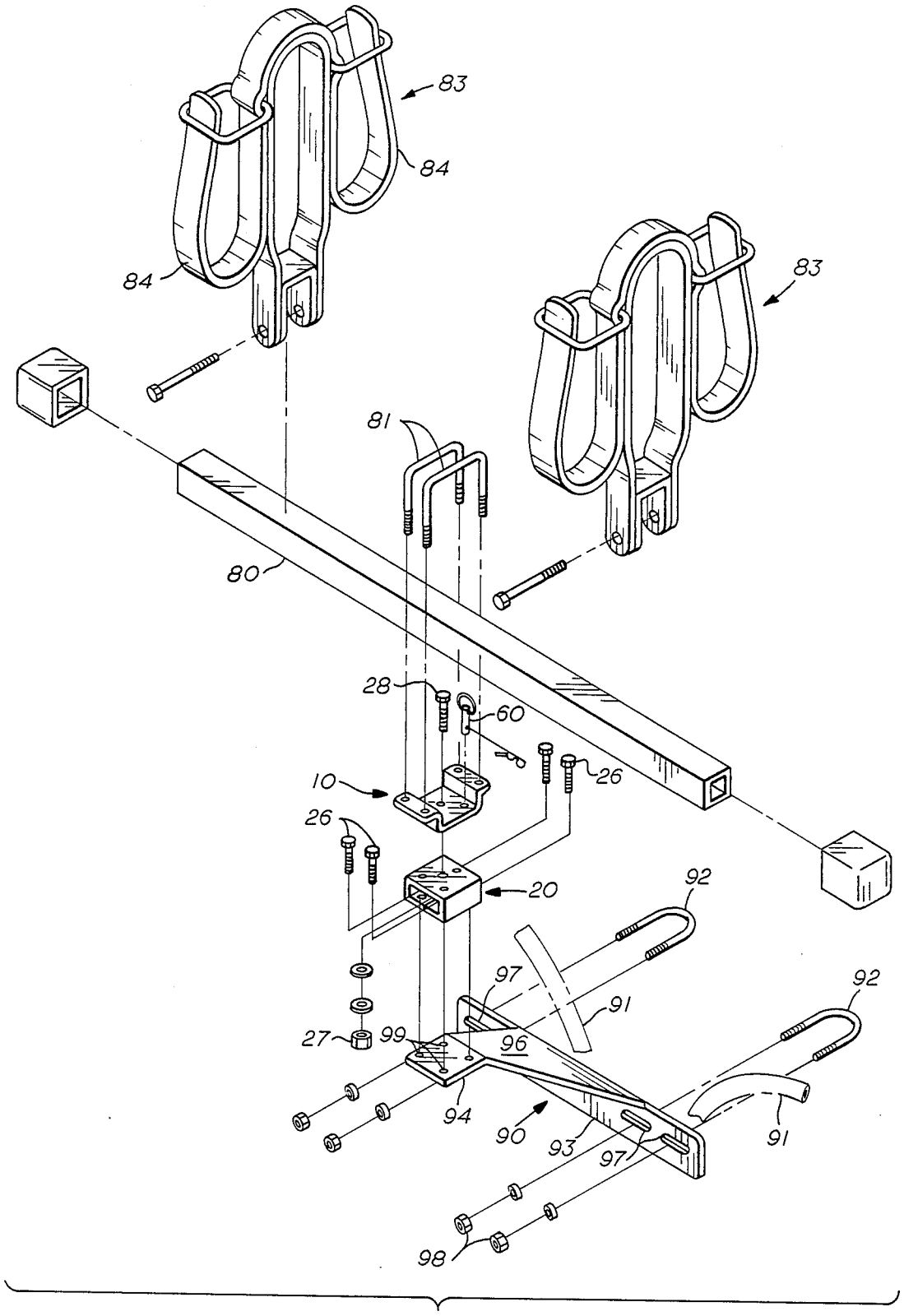
FIG. 1 is an exploded perspective of the adapter attached to a vehicle gun mount.

Gun mounts presently used on wheeled vehicles such as motorcycles, or all terrain vehicles, utilize a pair of U-bolts 92 to secure a mounting bracket 90 to the struts or handle bars 91 of such vehicles. The mounting plate bracket includes mounting portion 93, normally vertically positioned, horizontal plate portion 94, and connector web 96 linking said plates. Said web is angularly related to said vertical member 93, and generally horizontally positioned portion 94. Plate 93 has opposed pairs of apertures 97, to receive the shanks of U-bolts 92. Such bolts would secure the bracket to struts 91 by having nuts 98 threadedly engaged. Horizontal plate portion 94 normally includes 4 drilled holes 99 therethrough, forming the corners of a square, approximately $1\frac{1}{4}''$ spacing between the center lines of adjacent holes.

Figure 5:
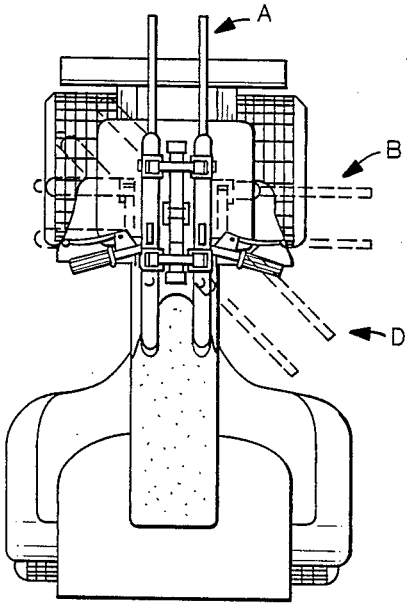
FIG. 5 is a schematic plan of an A.T.V. with a representation of alternate, carried positions of a gun.

Prior to this invention, such gun mounts had locking bar 80 secured directly to horizontal plate portion 94 of bracket 90, by a pair of U-bolts 81, each encircling bar 80, and having its shanks extend through apertures 99, to be secured by nuts (not shown). Such locking bars generally include slidable receivers 83, each such receiver including a pair of flexible clamp members 84, each clamp being adapted to receive the butt or stock of a rifle, thus permitting a user to secure two weapons thereto, in side by side relationship. Such arrangement of bar 90 to the apertures 99 in plate portion 94, permitted any carried guns to be aligned in either solid line position "A" or phantom line position "B" of FIG. 5, ie, along the axis of the vehicle, or perpendicular thereto.

Figure 3:
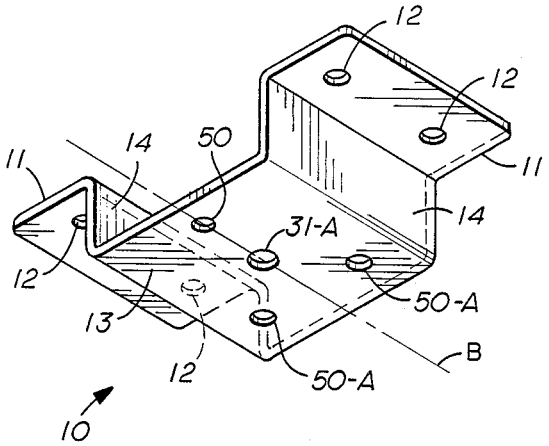
FIG. 3 is a perspective of the wing plate.
Figure 4:
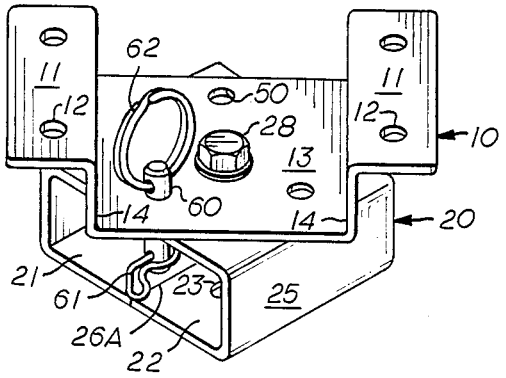
FIG. 4 is a perspective of the joined swivel cylinder and wing plate.
Figure 2:
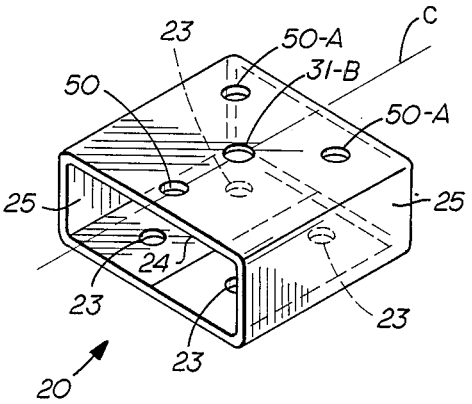
FIG. 2 is a perspective of the swivel cylinder.

Consider now the improvements of this invention, as particularly illustrated in FIGS. 2, 3 and 4. Positioned intermediate horizontal plate portion 94 and locking bar 80 is the adapter, comprised of box-like housing 20 and wing-shaped plate 10, the latter having an axis "B", and the former an axis "C". Said plate 10 includes opposed wings 11, and central web 13 connected to each wing by a skirt 14. Each wing includes a pair of spaced apertures 12 to receive the shanks of a U-bolt 81. Such U-bolts would encircle locking bar 80, and its shanks would be secured by bolts to said wing-shaped plate 10. It's web 13 also is apertured, ie, centrally at 31-A, axially at 50, and approximately 45 degrees on either side of said axis, at 50-A.

Member 20 may be made of a plate having the sme dimensions as member 10, except that said latter member's wings 11 would be folded outwardly from axis B. Thus box 20 includes web 24, skirts, 25, and lips 21, 22 having a narrow gap 26-A there between, defining axis "C". Lips 21, 22, collectively have four apertures 23, matching the four holes 99 possessed by plate portion 94 of bracket 90, enabling said cylinder 20 to be fixed to said bracket by bolts 26 and nuts 27. Obviously members 10 and 20, for fabrication, could utilized a similarly perforated plate, merely requiring opposite directions for wings 11 or lips 21, 22 to be bent. On the other hand, cylinder web 24 is perforated in the same manner as is plate web 13. Such perforations of web 24 may be aligned with those of web 13. Fastener 28 rotatably secures members 10, 20, allowing said wing shaped plate 10, with its associated locking bar 80 and carried weaponry, to rotate relative to member 20 and its linked bracket 90 and vehicle struts 91.

As mentioned, the perforations 50 and 50-A of both webs 13 and 24 may be aligned, say at 12 o'clock. As plate 10, and its carried gun, is rotated about fastener 28, one or more pairs of apertures will again be aligned at 3 o'clock, 4:30, 7:30 and 9:00. Thus, if desired, when the vehicle is moving straight ahead, a carried rifle may be pointed straight ahead, perpendicular thereto, or as specially permitted by this invention, at 45 degrees, right or left, from the axis "C" of member 20, the phantom line "D" position of FIG. 5. In other words a gun may point parallel to the front wheel or wheel's axle (position "B"), perpendicular to said axle (position "A"), or intermediate thereto (position "D"). Pin locking device, 60, with ring attachment 62, may be inserted through any aligned pair of apertures 50 or 50-A through webs 13 and 24, and be secured by cotter pin 61, to secure said webs from further rotation. At either of said 45 degree positions, the weapon is not directed straight ahead, nor at the driver. Further, it cuts a narrower swath thereby reducing the tendency to become fouled or discharged by nearby vegetation.

Although only a single embodiment, particularly of the aperture arrangements, has been described, it should be apparent that numerous modifications are possible by one skilled in the art without departing from the spirit of the invention, the scope of which is limited only by the following claims.

I claim:

1. An adapter for a gun mount carried by a handle bar guided wheeled vehicle, said vehicle including at least one front wheel, said adapter comprising:

first and second members rotatably connected;

means for releasably linking said first and second members in a plurality of positions;

means for connecting one of said members to said gun mount and means for joining the other of said members to said handle bar carried by said vehicle; and said plurality of positions includes at least one position wherein a gun carried by said gun mount points in a direction comprising forward movement of said vehicle, another position wherein said gun so carried points in a direction substantially perpendicular to said direction of forward movement, and a further position wherein said gun so carried points in a direction intermediate said directions of forward movement and substantially perpendicular thereto.

2. The adapter of claim 1 wherein said further position substantially bisects a right angle formed by said direction of forward movement and said direction substantially perpendicular thereto.

3. The adapter of claim 1 wherein said releasably linking means includes a central pivot member and a plurality of arcuately spaced, pin-receiving passageways through each of said first and second members.

4. The adapter of claim 3 wherein each of said first and second members comprises a web with depending skirts, one of said first and second members having lips inwardly directed from each of said skirts, forming a box, the other of said first and second members having lips outwardly directed from each of said skirts, forming a wing-like structure, said wing-like structure comprising at least a part of said connecting means and said box web comprising at least part of said joining means.

5. An adapter for a gun mount, said adapter comprising:

first and second members;

means for releasably and rotatably securing together said members in a plurality of positions, said means including a plurality of pin-receiving passageways through each member;

said plurality of positions comprises a first position wherein said passageways through each of said first and second members are aligned with their counterpart passageways through the other of said members, and a second position wherein at least some of said passageways are misaligned; and one of said members comprises a housing with inwardly turned lips, while the other of said members includes outwardly turned lips.

6. The gun mount of claim 5 wherein said first and second members each comprises a single plate of material and differences from each other, other than with respect to any passageways therethrough, are only in the direction in which their respective lips are turned.

7. A swivel mechanism for use with a gun mount carried by a handle bar guided, wheeled vehicle, said vehicle including at least one front wheel, said mechanism comprising:

first and second members rotatably connected;

means for releasably linking said members in a plurality of positions;

means for connecting one of said members to said gun mount and means for joining the other of said members to said handle bar carried by said vehicle; and said plurality of positions includes at least one position wherein a gun carried by said gun mount points in a direction comprising forward movement of said vehicle, another position wherein said gun so carried points in a direction substantially perpendicular to said direction of forwardly movement, and a further position wherein said gun so carried points in a direction intermediate said directions of forward movement and substantially perpendicular thereto.

8. A swivel mechanism comprising:

first and second members and means for permitting the securing of said members, respectively, to struts of a wheeled vehicle and to a gun mount;

means for rotatably securing said first and second members together in a plurality of positions, said means for rotatably securing including a plurality of pin-receiving passageways through each of said members;

said plurality of position comprises a first position wherein the said passageways through each of said first and second members are aligned with their counterpart passageways through the other of said members, and a second position wherein at least some of said passageways are misaligned; and one of said members comprises a housing with inwardly turned lips, while the other of said members includes outwardly turned lips.

9. The gun mount of claim 8 wherein said first and second members each comprises a single plate of material and differences from each other, other than with respect to any passageways therethrough, are only in the direction in which their respective lips are turned.

10. A vehicular gun mount for use with a handle bar guided wheeled vehicle, said vehicle including at least one front wheel, said gun mount comprising:

bracket means having means for permitting the securing of said bracket means to said handle bar carried by said vehicle;

clamp carrying rod means;

first and second members rotatably connected; means for releasably securing together said members in a plurality of positions;

means for connecting one of said members to said bracket means and means for joining the other of said members to said rod means; and said plurality of positions includes at least one position wherein a gun carried by said rod means points in a direction perpendicular to an axle of a front wheel of said vehicle, another position wherein said gun so carried points in a direction parallel to said axle, and a further direction wherein said gun so carried points in a direction intermediate said directions perpendicular to and parallel to said axle.

11. A vehicular gun mount comprising:

bracket means and means for permitting the securing of said bracket means to a vehicle;

clamp carrying rod means for receiving weaponry;

swivel mechanism linking said bracket means and said rod means, said swivel mechanism including first and second members, and means for rotatably securing said first and second members together in a plurality of positions;

said means for rotatably securing including a plurality of pin-receiving passageways through each said member;

said plurality of positions includes a first position wherein the said passageways through each of said first and second members are aligned with their counterpart passageways through the other of said members, and a second position wherein at least some of said passageways are misaligned; and one of said members comprises a housing with inwardly turned lips, while the other said member includes outwardly turned lips.

12. The gun mount of claim 11 wherein said first and second members each comprises a single plate of material and differences from each other, other than with respect to any passageways therethrough, are only in the direction in which their respective lips are turned.

* * * * *